United States Patent [19]

Hays

[11] 3,963,303

[45] June 15, 1976

[54] BATTERY TERMINAL CONNECTOR

[75] Inventor: Kenneth Scott Hays, Exton, Pa.

[73] Assignee: AMP Incorporated, Harrisburg, Pa.

[22] Filed: Oct. 15, 1974

[21] Appl. No.: 514,346

[52] U.S. Cl. ..... 339/237

[51] Int. Cl.[2] ..... H01R 11/26

[58] Field of Search ..... 339/116 R, 116 C, 224–240

[56] References Cited

UNITED STATES PATENTS

| | | | |
|---|---|---|---|
| 2,324,082 | 7/1943 | Helm | 339/116 R |
| 2,682,651 | 6/1954 | Thomas | 339/227 X |
| 2,818,552 | 12/1957 | Zam | 339/230 R |
| 3,377,609 | 4/1968 | Shannon et al. | 339/224 X |
| 3,636,504 | 1/1972 | Applegate | 339/237 X |
| 3,694,798 | 9/1972 | Julian | 339/224 |
| 3,757,283 | 9/1973 | Kelly | 339/230 |

*Primary Examiner*—Joseph H. McGlynn
*Assistant Examiner*—Howard N. Goldberg
*Attorney, Agent, or Firm*—Allan B. Osborne

[57] ABSTRACT

A battery terminal connector comprising a collar and a hollow elongated member connected thereto. Both the collar and the hollow elongated members are made of electrically non-conductive material. A liner is disposed within the collar and the hollow member. The liner is made of electrically conductive material. The collar fits over the terminal post of a battery so that the liner can be brought into electrical engagement with it. A battery cable can be connected to the portion of the liner which extends through the elongated hollow member.

2 Claims, 4 Drawing Figures

BATTERY TERMINAL CONNECTOR

This invention relates to a battery terminal connector and more particularly to a corrosion resistant, inexpensive, lightweight battery terminal connector.

Battery terminal connectors which are designed to replace the connectors which are installed as original equipment are often made of alloys which comprise a very large percentage of copper. Typically connectors of the type described may comprise about 93% to 94% copper. Copper is particularly suited for use in connectors because of its high conductivity and because it can be crimped to an electrical conductor to provide a good electrical connection. In recent years the cost of copper has increased greatly. Thus, it is desirable to develop battery terminals which have the advantages of those made with copper alloys but which are made in substantial part of materials which are less costly and substantially lighter in weight than copper. A substantial advantage in achieving this is to reduce the cost of battery terminals.

Further, it would be advantageous to make the battery terminal connectors from a material which provides a substantial amount of resistance to the corrosive forces which normally take their toll on battery terminal connectors.

It has been discovered that a battery terminal connector can be made from a lightweight electrically nonconductive thermoplastic material with a liner comprised of an electrically conductive copper alloy of the type that has been used heretofore. Such a connector would be lightweight and relatively inexpensive to manufacture. Further, it would be substantially corrosion free while only using a minimum amount of copper alloy.

Generally speaking the invention relates to a corrosion resistent, lightweight, battery terminal connector comprising a collar which includes an annular side wall. An aperture is disposed in the annular side wall. An elongated hollow member is supported on the collar with its opening being in communication with the aperture in the annular side wall. The collar and the elongated hollow member are comprised of electrically nonconductive material. A liner having first and second portions is comprised of electrically conductive material. One portion of the liner is disposed along the inner surface of the annular wall. Another portion of the liner extends through the hollow member. Means on the other portion of the liner are provided for engaging and enabling an electric circuit with a battery cable. Means are provided for urging the one portion of the liner against a battery post disposed in the collar to enable an electric circuit with the post.

For the purpose of illustrating the invention, there is shown in the drawings forms which are presently preferred; it being understood, however, that this invention is not limited to the precise arrangements and instrumentalities shown.

Figure 1:
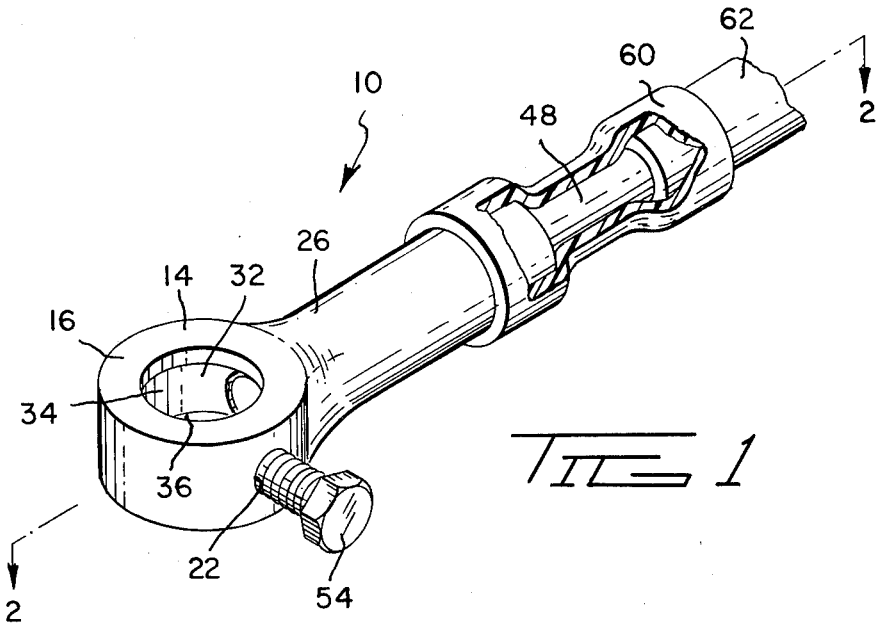
FIG. 1 is a perspective view of a battery terminal connector made in accordance with the invention coupled to a battery cable with a portion of the coupling broken away.

Now referring to the drawing for a detailed description of the invention, the battery terminal connector 10 is illustrated in FIG. 1. It comprises a collar 14 which includes an annular side wall 16.

The annular side wall 16 includes first and second apertures 20 and 22. The apertures are circumferentially spaced from each other around the annular side wall 16. The annular side wall supports a hollow elongated member 26 which is disposed thereon so that the opening therein is in communication with aperture 20.

Both the collar 14 and the hollow elongated member 26 are made of a suitable electrically nonconductive material. Preferably, a suitable material for use would be a rigid thermoplastic such as nylon. Further, collar 14 and member 26 may comprise a unitary element.

A recess 32 defined by bottom wall 34 and side walls 36 may be formed on the inner surface of annular wall 16.

Figure 3:
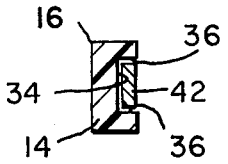
FIG. 3 is a sectional view taken along line 3—3 of FIG. 2.

A liner 40 made of an electrically conductive material such as the copper alloy mentioned above is comprised of first and second portions 42 and 44. The first portion 42 of the liner is disposed within collar 16 and may comprise a generally arcuately shaped member which is normally disposed along the inner surface of annular wall 16. Preferably, it is a relatively flat member as seen in FIG. 3 and is normally disposed in recess 32 with one of its major surfaces disposed along bottom wall 34 so that it will not be damaged by being struck by the battery post as it is mounted thereon. Further, the flat member comprising the first portion 42 is of sufficient length so that it can extend beyond aperture 22 for a reason which will be described.

The other portion 44 of the liner may be a cylindrical member which extends through the opening in the elongated hollow member 26. As illustrated in the drawing, the distal end 48 of portion 44 extends outwardly beyond the end of the hollow member 26. This provides a means for engaging and enabling an electric circuit with a battery cable as will be explained further. To this extent second portion 44 may be hollow throughout its entire length in order to provide an opening into which the battery cable may be received. However, in the alternative, satisfactory results may be achieved if the second portion is solid throughout its length with a blind hole 50 being formed in the distal end 48 as illustrated.

Means are provided for urging the first portion 42 of the liner 40 generally radially inwardly of the collar 14 to engage a battery post which is disposed within the collar. The means includes above mentioned aperture 22 which is provided with threads (not shown) on its interior surface. An elongated threaded member 54 such as the bolt or screw illustrated is threadingly received within aperture 22. Threaded member 54 may be made from the same thermoplastic material as the collar 16 and elongated hollow member 26. As is apparent from the drawing, as threaded member 54 is advanced in aperture 22, portion 42 of the liner will be urged generally radially inwardly to engage and make electrical contact with the battery post.

An elongated sleeve 60 comprised of a substantially electrically nonconductive, thermoshrinkable material is provided. The nature of the material from which the sleeve 60 is made is not relevant to the inventive subject matter disclosed herein. Suitable materials are well known and are readily available on the commercial market. A suitable material may be a thermally stabilized modified polyolefin such as that manufactured by AMP Incorporated of Harrisburg, Pennsylvania. The sleeve is of sufficient length so that it can be telescopically received over and can extend from the elongated hollow member 26 to the insulation on a battery cable 62 thereby overlying and insulating the juncture of the battery cable conductor 64 and the liner 44.

Figure 4:
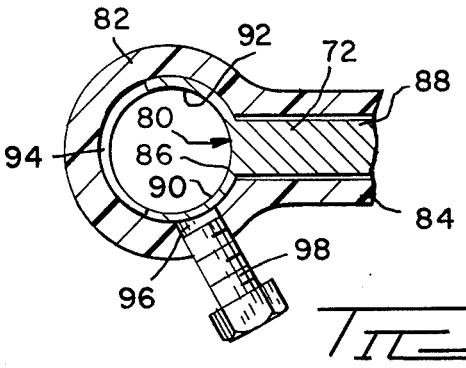
FIG. 4 is a view similar to FIG. 2 but showing a modified form of the battery terminal connector.

FIG. 4 shows a modified form of battery terminal connector. In the modified form of the invention a liner 80 may be placed in a collar 82 and hollow elongated member 84 similar to that illustrated and described in connection with FIG. 1.

The liner which may be made from an electrically conductive copper alloy such as that described above includes first and second portions 86 and 88. First portion 86 includes two generally arcuately shaped relatively flat members 90 and 92 which may be normally disposed in recess 94. They are connected to the second portion 88 which extends through the opening in hollow elongated member 84. Member 90 is positioned so that it overlies aperture 96 so that when portion 90 is urged radially inwardly as elongated threaded member 98 is advanced in the aperture the battery post is engaged by members 90 and 92 thereby enabling an electric circuit from the battery post through the battery terminal connector.

In order to use the battery terminal connector described herein it is first necessary to remove the old battery terminal connector from the battery cable. If necessary the insulation is stripped from the battery cable so that a suitable length of conductor 64 is exposed. Elongated sleeve 60 is slipped over cable 62 so that the conductor is exposed. The conductor is inserted in blind hole 50 in the distal end 48 of liner 40. It may be secured to the liner by being crimped by a suitable crimping tool. Crimping offers the advantages of making a secure mechanical connection between the two elements being crimped while at the same time providing a maximum amount of surface contact to insure good electrical conductivity. Sleeve 60 is then slipped over the distal end 48 of the liner so that its ends rest respectively on the elongated hollow member 26 and on the insulation of the cable 62. A suitable source of heat is applied to sleeve 60 to shrink it into tight fitting insulating relation to the distal end 48, the hollow member 26 and the cable 62. After the sleeve has been shrunk a permanent electrically insulated connection has been formed between the connector 10 and the cable 62. Significantly, there are no exposed elements which are electrically conductive since the exposed portions of the collar, elongated hollow member and juncture of the connector and battery cable are comprised of electrically nonconductive materials.

The connector 10 may then be placed over a battery post. After it is located on the post the elongated threaded member 54 is advanced in aperture 22 in order to urge portion 42 of the liner radially inwardly to engage the battery posts.

With the battery post in engagement with portion 42 an electrical circuit is enabled by way of portion 42, portion 40 and the conductor 64 to the battery cable.

Figure 2:
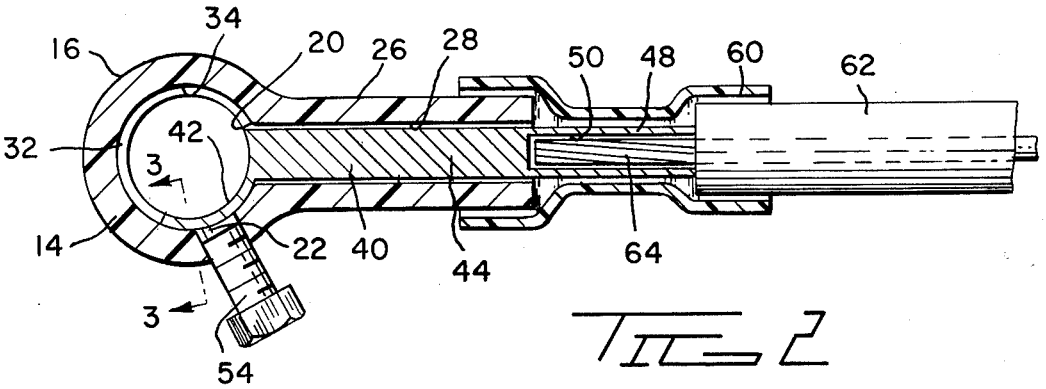
FIG. 2 is a sectional view taken along line 2—2 of FIG. 1.

When the connector is illustrated in FIG. 4 is utilized, the identical procedure as outlined above is also employed. However, in this form the battery post makes contact with liner portions 90 and 92. In all its other aspects operation of the connector illustrated in FIG. 4 is the same as that for the connector illustrated in FIGS. 1 and 2.

It should be appreciated that the connector described herein is relatively simple to manufacture, as, for example, by an injection molding process where the liner is placed in the mold and the thermoplastic plastic material is injected around it. The conductor uses a minimum amount of copper with the result that its cost is substantially lower than a connector which is made primarily of copper. Further, because it is made of a thermoplastic material, the problems known heretofore in connection with corrosion have been substantially eliminated.

While the invention has been described with reference to certain forms and embodiments thereof, it is apparent that many other forms and embodiments will be obvious to those skilled in the art in view of the foregoing description. Thus, the scope of the invention should not be limited by the foregoing description but, rather, only by the scope of the claims appended hereto.

What is claimed is:

1. A corrosion resistant, light weight battery terminal connector comprising, a collar, said collar including an annular side wall; an aperture, said aperture being disposed in said annular side wall; an elongated hollow member, said hollow member being supported on said collar with the opening in said hollow member being in communication with the aperture in said annular sidewall; said collar and said elongated hollow member being comprised of rigid, electrically nonconductive material; a liner, said liner being comprised of electrically conductive material, one portion of said liner being disposed along the inner surface of said annular wall, a recess in the inner surface of said annular wall, said one portion of said liner normally being disposed in said recess, another portion of said liner extending through said hollow member; means on said other portion of said liner for engaging and enabling an electrical circuit with a battery cable; means for urging said one portion of said liner against a battery post disposed in said collar to enable an electric circuit with the post, said last name means comprising a second aperture in said annular wall, said second aperture including threads, an elongated member with complimentary threads, said elongated member being receivable within said second aperture, said one portion of said liner overlying said second aperture, and means for advancing said elongated member through said second aperture and into engagement with said liner so that it is urged against the battery post.

2. A battery terminal connector as defined in claim 1 wherein said one portion of said liner is flat and is disposed in said recess with one of its major surfaces disposed along the bottom of said recess.

* * * * *